US006293453B2

(12) United States Patent
Hirose et al.

(10) Patent No.: US 6,293,453 B2
(45) **Date of Patent: *Sep. 25, 2001**

(54) APPARATUS AND METHOD FOR CONTROLLING DRAG ROLLER

(75) Inventors: Hitoshi Hirose; Yoshio Ueda; Masakazu Akatsuka; Norifumi Tasaka, all of Hiroshima-ken (JP)

(73) Assignee: Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/306,404

(22) Filed: May 6, 1999

(51) Int. Cl.[7] ..... B65H 23/18; B65H 26/08; B28Q 15/12

(52) U.S. Cl. ..... 226/40; 226/30; 226/45

(58) Field of Search ..... 226/4, 24, 30, 226/45, 40; 101/228, DIG. 42

(56) References Cited

U.S. PATENT DOCUMENTS 5,170,215 * 12/1992 Pfeuffer .
5,269,222 12/1993 Johnson et al. ..... 101/228
5,561,512 * 10/1996 Fukano et al. .
5,718,394 2/1998 Simons et al. ..... 242/420.6
5,907,741 * 5/1999 Matsuzawa et al. .

FOREIGN PATENT DOCUMENTS 30 20 847 A1 1/1981 (DE) .
0 722 095 A1 5/1997 (EP) .
0 888 901 A1 1/1999 (EP) .
0 914 944 A2 5/1999 (EP) .
2 247 646 8/1994 (GB) .

OTHER PUBLICATIONS

Japanese Patent Abstract Feb. 20, 1998.*

* cited by examiner

*Primary Examiner*—Donald P. Walsh
*Assistant Examiner*—Minh-Chau Pham
(74) *Attorney, Agent, or Firm*—Armstrong, Westerman, Hattori, McLeland & Naughton, LLP

(57) ABSTRACT

An apparatus for and a method of controlling a drag roller in a printing machine to move a web with no shift of a printing position and enhance the printing quality remarkably, even when the drag roller varies in diameter due to its temperature change. From a given temperature-rotational-speed table, a controlling unit obtains a rotational speed of the drag roller so as to adjust a circumferential speed of the drag roller, which speed corresponds to the current circumferential surface temperature checked by a temperature monitor unit. Then, a rotational speed changing unit changes the rotational speed of the drag roller to a value equivalent to the rotational speed obtained by the controlling unit.

11 Claims, 6 Drawing Sheets

1: PAPER FEEDING DRAG ROLLER
2: INTERMEDIATE DRAG ROLLER
3: PAPER DISCHARGING DRAG ROLLER
8: TEMPERATURE MONITORING UNIT
9: ROTATIONAL SPEED CHANGING UNIT
10: CONTROLLING UNIT
11: AC SERVO MOTOR

WEB TRANSFER QUANTITY $vt$ : CONSTANT CONTROL $$vt = \pi Do\ No \cdot t = \pi DN \cdot t$$

$$Do < D \qquad No > N$$

AT START OF OPERATION : DIAMETER Do ROTATIONAL SPEED No

AT RAISED TEMPERATURE : DIAMETER D ROTATIONAL SPEED N

CIRCUMFERENTIAL SPEED $Vo = \pi DoN$ $V = \pi DN$ $Do < D$ $Vo < V$

WEB TRANSFER QUANTITY : S $So = Vo \cdot t$ $S = V \cdot t$ $So < S$

APPARATUS AND METHOD FOR CONTROLLING DRAG ROLLER

BACKGROUND OF THE INVENTION

1) Field of the Invention

The present invention relates to an apparatus for and a method of controlling a drag roller in a web type electronic printing machine, and more particularly, to a drag roller control apparatus and a drag roller control method which can control the traveling state (e.g., tension, elongation, etc.) of a web being fed.

2) Description of the Related Art

FIG. 5 shows a diagram used to explain how a web in a general web type electronic printing machine is fed.

As shown in the diagram, the web type electronic printing machine is constituted by a web feeding unit 4, a preheating roller 12, a plurality of sets of printing units 7*a*~7*d*, a paper feeding roller 1, a paper discharging roller 3, an intermediate drag roller 2 interposed between the printing units 7*b* and 7*c*, and a plurality of guide rollers 13 for serially guiding a web 6 to these units. Note in FIG. 5 that reference numerals 14*a* and 14*b* denote fixing rollers.

While FIG. 5 shows the web type electronic printing machine for performing 4-color printing on the obverse of the web 6, it may be a printing machine further provided with a plurality of sets of printing units. Also, it may be a duplex multicolor printing machine. That is, between the printing units, for example, between the printing units 7*b* and 7*c*, a web inverting mechanism is disposed and constructed so that the obverse and reverse of the web 6 are inverted. After 2-color printing has been performed on the obverse side of the web 6, 2-color printing is performed on the reverse side.

In the above-mentioned construction, the web 6, unwound from a rolled web 5 set in the web feeding unit 4, is moderately heated as it travels around the preheating roller 12. Then, the web 6 is fed to the first and second printing units 7*a* and 7*b* via the paper feeding roller 1. Next, after toner for 2-color printing has been attached to the obverse side of the web 6 with the first and second printing units 7*a* and 7*b*, the web 6 is further transferred to the fixing roller 14*a*. With this fixing roller 14*a*, the printing toner is fixed to the obverse of the web 6, whereby 2-color printing is performed on the obverse side of the web 6.

The web 6 on which 2-color printing has thus been performed is fed to the third and fourth printing units 7*c* and 7*d* via the intermediate drag roller 2. Then, after different toner for 2-color printing has further been attached to the obverse side of the web 6 with the third and fourth printing units 7*c* and 7*d*, the web 6 is transferred to the second fixing roller 14*b*. With this fixing roller 14*b*, the printing toner is fixed to the obverse of the web 6, whereby 4-color printing is performed on the obverse side of the web 6.

Next, after the aforementioned printing of the web 6 has been completed, the web 6 is subsequently sent out to the processes on the downstream side, in which various processing, such as cutting, folding and the like, are performed.

Incidentally, such a conventional web type electronic printing machine adopts a method of controlling the rotational speed N of the paper feeding roller 1, intermediate drag roller 2, and paper discharging roller 3 with a high degree of accuracy and adjusting the amount that the web is fed to the printing units 7*a*~7*d* and the amount that the web is delivered from the printing units 7*a*~7*d*, in order to suitably control the traveling state (e.g., tension, elongation, etc.) of the web 6 that is fed to the above-mentioned printing units 7*a*~7*d*.

This method, however, has the following problems.

FIG. 6 is a diagram for explaining the problems of the conventional web type electronic printing machine. As shown in this diagram, the temperature of the intermediate drag roller 2 and paper discharging roller 3 is nearly the same as the room temperature (normal temperature) before or at the beginning of start of operation. However, after start of operation, the intermediate drag roller 2 and the paper discharging roller 3 gradually increase in temperature, because they are contacted by the web 6 heated by the fixing rollers 14*a* and 14*b*. Because of this, the intermediate drag roller 2 and the paper discharging roller 3 expand, and the respective diameters increase as shown by reference numeral 2' (3') in FIG. 6.

Similarly, the paper feeding roller 1 gradually rise in temperature after start of operation, because it is contacted by the web 6 heated by the preheating roller 12. Because of this, the paper feeding roller 1 expands and its diameter increases.

With reference to this, a more detailed description will be made. As shown in FIG. 6, assume that the initial diameter of each of the drag rollers 1, 2, and 3 is $D_0$. Also, the diameter after expansion of each of the drag rollers 1, 2, and 3 after start of operation is assumed to be D ($D_0$<D). Furthermore, the rotational speed N of each of the drag rollers 1, 2, and 3 is assumed to be constant. At this time, the initial circumferential speed $v_0$ of each of the drag rollers 1, 2, and 3, the circumferential speed v ($v_0$<v) after expansion of each of the drag rollers 1, 2, and 3 after start of operation, and a difference (difference in circumferential speed) Δv between the initial circumferential speed $v_0$ and the after-expansion circumferential speed v are expressed by the following equations (1), (2), and (3):

Initial circumferential speed:

$$v_0=\pi D_0 N \tag{1}$$

After-expansion circumferential speed:

$$v=\pi D N \tag{2}$$

Difference in circumferential speed:

$$\Delta v=v-v_0=\pi(D-D_0)\cdot N \tag{3}$$

Thus, if the respective temperatures of the drag rollers 1, 2, and 3 increase, the circumferential speeds of the drag rollers 1, 2, and 3 will increase. Therefore, the respective quantities that the web is transferred by the drag rollers 1, 2, and 3 increase, as shown in FIG. 6.

Here, the initial web transfer quantity $S_0$ and the web transfer quantity S ($S_0$<S) after expansion can be expressed with time as t by the following equations (4) and (5):

Initial web transfer quantity:

$$S_0=v_0\cdot t \tag{4}$$

Web transfer quantity after expansion:

$$S=v\cdot t \tag{5}$$

Thus, if the respective quantities that the web is transferred by the drag rollers 1, 2, and 3 are increased, the traveling state (i.e., the state of the tension, deformation of elongation, etc. of the web 6) of the web 6 to be fed to the printing units 7*a*~7*d* will change considerably. That is, if the respective temperatures of the drag rollers 1, 2, and 3 increase, the respective diameters will increase. With this, the web transfer quantity is also increased and the state of the tension, deformation of elongation, etc. of the web 6 to be fed to the printing units 7*a*~7*d* changes considerably.

Thus, only the control of the respective speeds N of the drag rollers 1, 2, and 3 at the same ratio causes the transfer quantity of the web 6 to change. As a result, since the state of the web (such as tension, deformation of elongation, and the like) changes, there is a problem that the printing position will shift.

Particularly, at the transition time from start of operation to the temperature stability of the drag rollers 1, 2, and 3, the temperature changes of the drag rollers 1, 2, and 3 are conspicuous. Therefore, no matter how accurately the respective speeds N of the drag rollers 1, 2, and 3 are controlled, the printing position will continue to shift.

SUMMARY OF THE INVENTION

The present invention has been made in view of the aforementioned problems. Accordingly, it is an object of the present invention to provide a drag roller control apparatus and a drag roller control method which are capable of stably moving a web to prevent a printing position from shifting and enhance printing quality considerably, even when a drag roller varies in diameter.

For this reason, a drag roller control apparatus according to the present invention comprises: a temperature monitoring unit for checking a temperature of the drag roller, by which a printing web is pulled, in a printing system; a controlling unit, operatively connected with the temperature monitoring unit, for issuing a control signal for controlling a rotational speed of the drag roller so as to adjust a circumferential speed of the drag roller, which speed corresponds to the temperature checked by the temperature monitoring unit, to a preset speed corresponding to a reference temperature of the drag roller; and a rotational speed changing unit, operatively connected with the controlling unit, for changing the rotational speed of the drag roller in accordance with the control signal issued from the controlling unit.

Therefore, according to the drag roller control apparatus of the present invention, the rotational speed of the drag roller is controlled based on the temperature checked by the temperature monitoring unit. For this reason, the drag roller control apparatus can stably transfer the web regardless of a variation in the diameter of the drag roller due to the temperature change of the drag roller. With this, the drag roller control apparatus can remove the disadvantage that the printing position shifts due to a variation in the tension (elongation) of the web. With this, there is an advantage that printing quantity can be considerably enhanced. In connection with this, the number of sheets of damaged paper resulting from defective printing is reduced, so that there is also an advantage that cost reduction can be achieved.

Also, it is preferable that the controlling unit be associated with a temperature-speed table in which prospective rotational speeds corresponding to various temperatures of the drag roller are previously set. Furthermore, the controlling unit may be associated with: a temperature-diameter table in which prospective drag roller diameters corresponding to various temperatures of the drag roller are previously registered; and a diameter-speed table in which prospective rotational speeds corresponding to the drag roller diameters registered in the temperature-diameter table are previously set.

Also, the temperature monitoring unit may include a thermometer for directly measuring the temperature of the drag roller. In addition, the temperature monitoring unit may include a thermometer for indirectly measuring the temperature of the drag roller in terms of a temperature of the web pulled by the drag roller. Furthermore, the temperature monitoring unit may include a non-contact type thermometer.

Also, the rotational speed changing unit may include a motor adapted to be operatively connected to the drag roller; and a motor controller operatively connected to the motor for controlling a rotational speed of the motor in accordance with the control signal issued from the controlling unit.

In addition, the rotational speed changing unit may include a motor adapted to be operatively connected to the drag roller via a continuously variable transmission; and a continuously variable transmission controller for issuing a transmission control signal for controlling a gear ratio of the continuously variable transmission in accordance with the control signal issued from the controlling unit.

A drag roller control apparatus according to the present invention comprises: a diameter monitoring unit for checking a diameter of the drag roller, by which a printing web is pulled, in a printing system; a controlling unit, operatively connected with the diameter monitoring unit, for issuing a control signal for controlling a rotational speed of the drag roller so as to adjust a circumferential speed of the drag roller, which speed corresponds to the diameter checked by the diameter monitoring unit, to a preset speed corresponding to a reference diameter of the drag roller; and a rotational speed changing unit, operatively connected with the controlling unit, for changing the rotational speed of the drag roller in accordance with the control signal issued from the controlling unit.

Therefore, according to the drag roller control apparatus of the present invention, the rotational speed of the drag roller is controlled based on the diameter of the drag roller checked by the diameter monitoring unit. For this reason, the drag roller control apparatus can stably transfer the web regardless of a variation in the diameter of the drag roller. With this, the drag roller control apparatus can remove the disadvantage that the printing position shifts due to a variation in the tension (elongation) of the web. With this, there is an advantage that printing quantity can be considerably enhanced. In connection with this, the number of sheets of damaged paper resulting from defective printing is reduced, so that there is also an advantage that cost reduction can be achieved.

Also, it is preferable that the rotational speed changing unit include a motor adapted to be operatively connected to the drag roller; and a motor controller operatively connected to the motor for controlling a rotational speed of the motor in accordance with the control signal issued from the controlling unit.

Furthermore, the rotational speed changing unit may include a motor adapted to be operatively connected to the drag roller via a continuously variable transmission, and a continuously variable transmission controller for issuing a transmission control signal for controlling a gear ratio of the continuously variable transmission in accordance with the control signal issued from the controlling unit.

A drag roller control method according to the present invention comprises the steps of: checking an temperature of the drag roller by a temperature monitoring unit; issuing a control signal for controlling a rotational speed of the drag roller so as to adjust a circumferential speed of the drag roller, which speed corresponds to the temperature checked in the temperature checking step, to a preset speed corresponding to a reference temperature of the drag roller by a controlling unit operatively connected with the temperature monitoring unit; and changing the rotational speed of the drag roller in accordance with the control signal issued in the control signal issuing step by a rotational speed changing unit operatively connected with the controlling unit.

Therefore, according to the drag roller control method of the present invention, the rotational speed of the drag roller is controlled based on the temperature checked by the temperature monitoring unit. For this reason, the drag roller control method can stably transfer the web regardless of a variation in the diameter due to the temperature change of the drag roller. With this, the drag roller control apparatus can remove the disadvantage that the printing position shifts due to a variation in the tension (elongation) of the web. With this, there is an advantage that printing quantity can be considerably enhanced. In connection with this, the number of sheets of damaged paper resulting from defective printing is reduced, so that there is also an advantage that cost reduction can be achieved.

Also, it is preferable that the control signal issuing step include previously setting prospective rotational speeds corresponding to various temperatures of the drag roller into a temperature-speed table. Furthermore, the control signal issuing step may include: previously registering drag roller diameters corresponding to various temperatures into a temperature-diameter table, and previously setting rotational speeds of the drag roller corresponding to the drag roller diameters, which is registered in a temperature-diameter table in the drag roller diameters registering step, into a diameter-speed table.

Also, the temperature checking step may include directly measuring the temperature of the drag roller by a thermometer. Furthermore, the temperature checking step may include indirectly measuring the temperature of the drag roller in terms of a temperature of the printing web, which is pulled by the drag roller, by a thermometer.

Moreover, it is preferable that the rotational speed changing unit to be used in the rotational speed changing step include: a motor adapted to be operatively connected to the drag roller; and a motor controller, operatively connected to the motor, for controlling a rotational speed of the motor in accordance with the control signal, which is issued from the controlling unit, to change the rotational speed of the drag roller in terms of a rotational speed change of the motor.

In addition, it is preferable that the rotational speed changing unit to be used in the rotational speed changing step include: a motor adapted to be operatively connected to the drag roller via a continuously variable transmission; and a continuously variable transmission controller for issuing a transmission control signal for controlling a gear ratio of the continuously variable transmission in accordance with the control signal, which is issued from the controlling unit, to change the rotational speed of the drag roller in terms of a gear ratio change of the continuously variable transmission.

A drag roller control method according to the present invention comprises the steps of: checking a diameter of the drag roller; and controlling a rotational speed of the drag roller so as to adjust a circumferential speed of the drag roller, which speed corresponds to the drag roller diameter checked in the diameter checking step, to a preset speed corresponding to a reference diameter of the drag roller.

Therefore, according to the drag roller control method of the present invention, the rotational speed of the drag roller is controlled based on the diameter of the drag roller. For this reason, the drag roller control method can stably transfer the web regardless of a variation in the diameter of the drag roller. With this, the drag roller control apparatus can remove the disadvantage that the printing position shifts due to a variation in the tension (elongation) of the web. With this, there is an advantage that printing quantity can be considerably enhanced. In connection with this, the number of sheets of damaged paper resulting from defective printing is reduced, so that there is also an advantage that cost reduction can be achieved.

A drag roller control apparatus according to the present invention comprises: a checking unit for checking a parameter, on which a circumferential speed of the drag roller, by which a printing web is pulled, in a printing system, depends; a controlling unit for issuing a control signal for controlling a rotational speed of the drag roller so as to adjust a circumferential speed of the drag roller, which speed corresponds to the parameter checked by the checking unit, to a preset speed corresponding to a reference parameter of the drag roller.

BRIEF DESCRIPTION OF THE DRAWINGS

The present invention will be described in further detail with reference to the accompanying drawings wherein.

DESCRIPTION OF THE PREFERRED EMBODIMENTS

An embodiment of the present invention will hereinafter be described by the drawings.

A drag roller control apparatus according to this embodiment is equipped in a web type electronic printing machine that performs predetermined printing on a web being fed.

Figure 1:
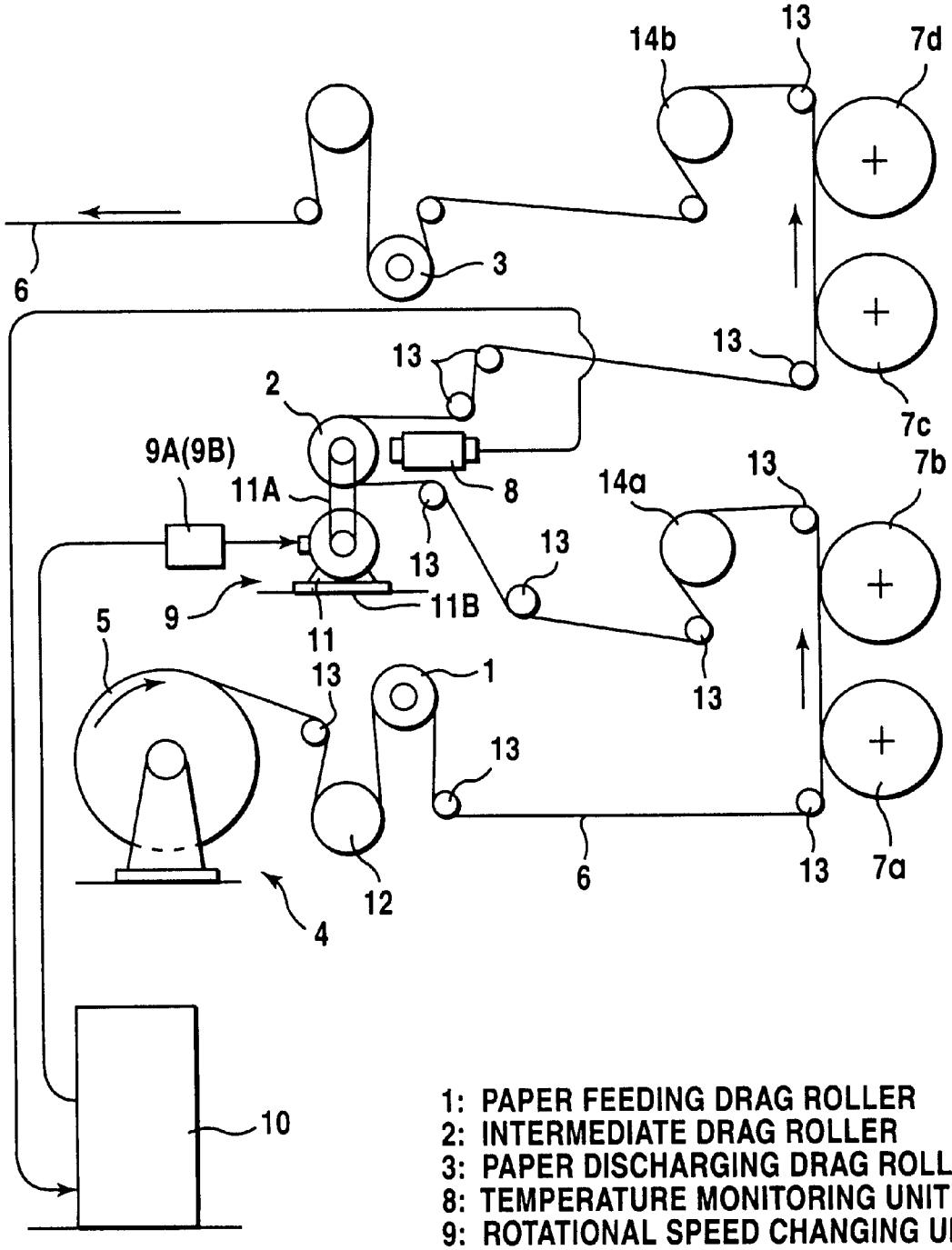
FIG. 1 is a schematic diagram of a drag roller control apparatus according to an embodiment of the present invention which is equipped in a web type printing machine.

This web type electronic printing machine, as shown in FIG. 1, serially feeds a web 6 unwound from a rolled web 5 set in a web feeding unit 4 to printing units 7*a*~7*d* via a paper feeding roller (drag roller) 1, an intermediate roller (drag roller) 2, and a paper discharging roller (drag roller) 3, and performs predetermined printing on the obverse of the fed web 6.

Figure 5:
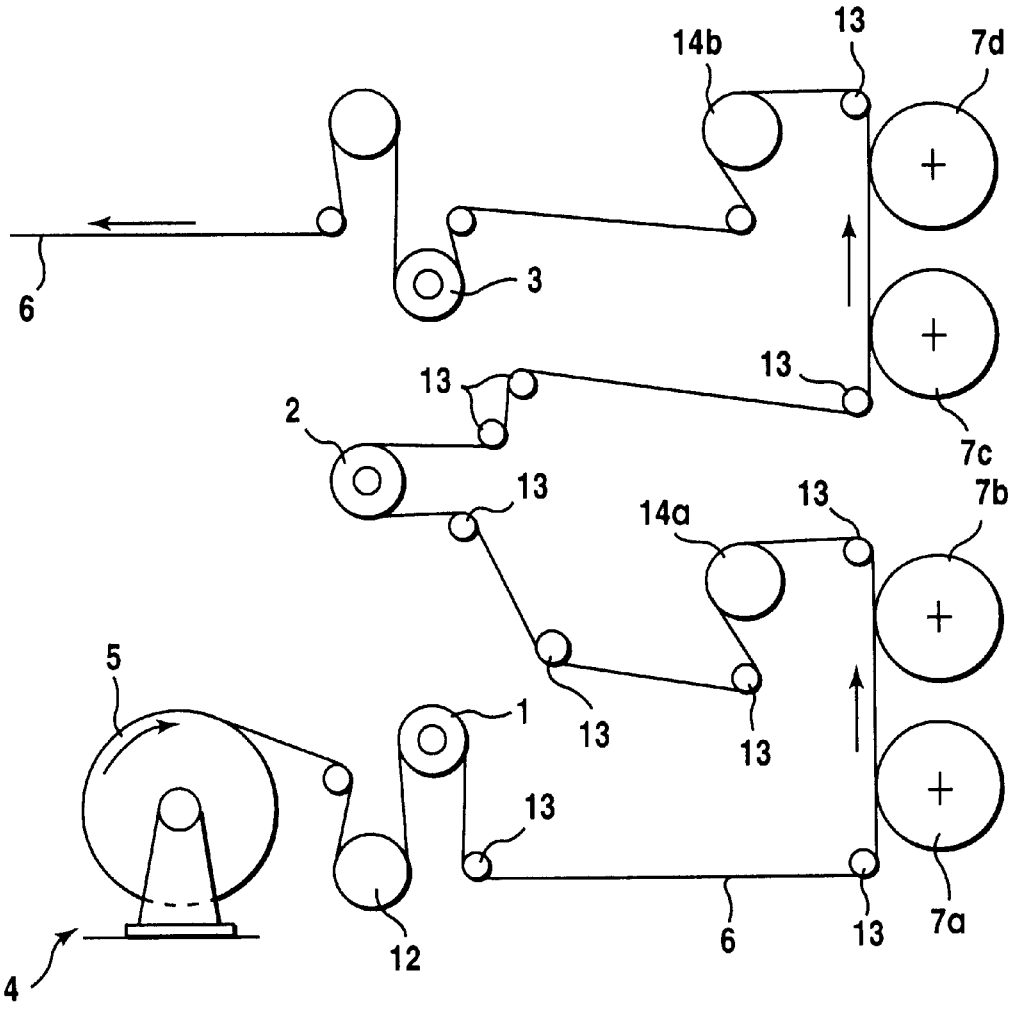
FIG.5 PRIOR ART
FIG. 5 is a schematic diagram of a drag roller control apparatus for a conventional web type printing machine.
Figure 6:
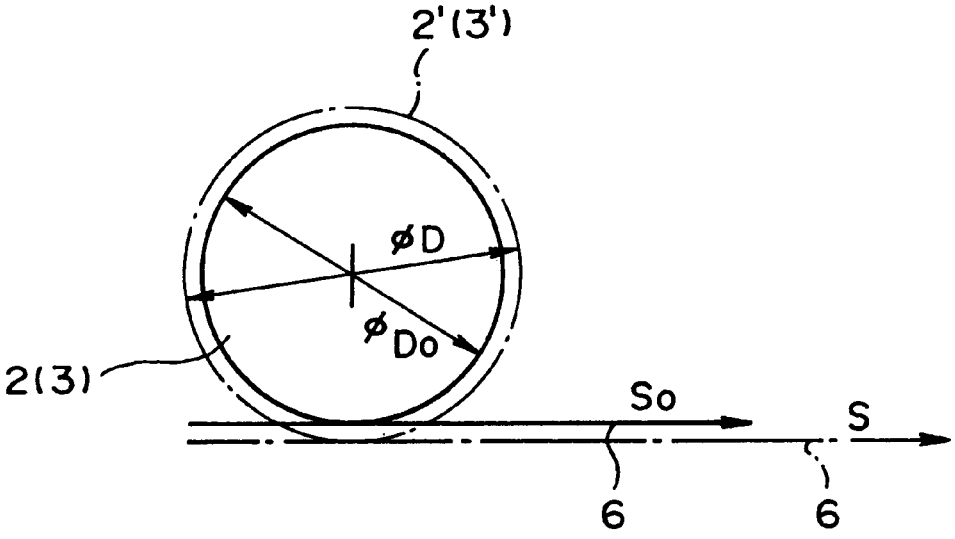
FIG. 6 is a diagram for explaining the problems of the drag roller control apparatus equipped in the conventional web type printing apparatus.

Note that this web type electronic printing machine is identical in construction and operation with the aforementioned prior art (see FIG. 5) and therefore a detailed description thereof is omitted. Also, in FIG. 1 the same reference numerals will be applied to the same parts as the conventional web type electronic printing machine shown in FIG. 5.

Now, a description will be made of the drag roller control apparatus according to this embodiment.

The drag roller control apparatus of this embodiment, as shown in FIG. 1, is constituted by a temperature monitoring unit including thermometer 8 for checking the exterior circumferential surface temperature (outside periphery temperature) of the intermediate drag roller 2 equipped in a web type electronic printing machine such as the aforementioned, a controlling unit 10 for issuing a control signal for controlling the rotational speed of the intermediate drag roller 2 so as to adjust a circumferential speed of the intermediate drag roller 2, which speed corresponds to the exterior circumferential surface temperature checked by the temperature monitoring unit 8, to a preset speed corresponding to a reference exterior circumferential surface temperature (reference temperature) of the intermediate drag roller 2, and a rotational speed changing unit 9 for changing the rotational speed of the intermediate drag roller 2 in accordance with a signal from the controlling unit 10. Note that the preset speed is a target speed corresponding to the preset reference exterior circumferential surface temperature under which a web can be moved without any shift of a printing position.

The thermometer 8 here is, for example, a non-contact type thermometer such as a radiation thermometer, a quartz thermometer, a fiber-optic thermometer and the like.

This thermometer 8 is disposed at a position adjacent to the intermediate drag roller 2 so as to be opposed to the exterior circumferential surface of the intermediate drag roller 2 in order to directly measure the exterior circumferential surface temperature of the intermediate drag roller 2. Thus, by setting the thermometer 8 at a position such that the exterior circumferential surface temperature of the intermediate drag roller 2 can be directly measured, a variation in the diameter of the intermediate drag roller 2 can be calculated more accurately.

Figure 2:
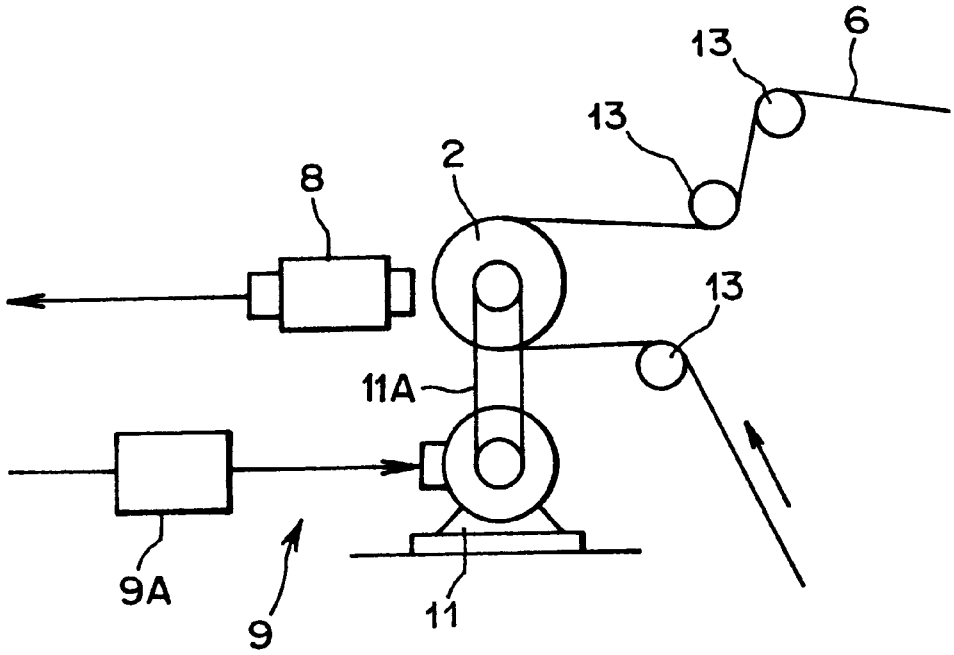
FIG. 2 is a diagram for explaining another layout example of the temperature measuring unit for a drag roller according to the embodiment of the present invention.

In this embodiment, while the thermometer 8 is provided at a position such that the exterior circumferential surface temperature of the intermediate drag roller 2 can be directly measured, the present invention is not limited to this. For instance, as shown in FIG. 2, the thermometer 8 may be provided at a position such that the exterior circumferential surface temperature of the intermediate drag roller 2 can be indirectly measured via the web 6 pulled by the intermediate drag roller 2. In this case, there is a need to make a predetermined correction of the measured value of the thermometer 8, but there is an advantage that the flexibility of a design (manufacturing) increases with respect to a space for installation.

Also, the thermometer 8 is not to be limited to a non-contact thermometer as in this embodiment, but may be of another type. For instance, it may be a contact-type thermometer that contacts the main body or shaft end portion of the intermediate drag roller 2 to measure the exterior circumferential surface temperature. As an example of this contact-type thermometer, there is a thermistor, a thermocouple, a resistor bulb, an optical thermometer, etc.

The rotational speed changing unit 9 is equipped with an AC servo motor 11 adapted to be connected to the shaft end portion of the intermediate drag roller 2 through a belt 11A, and a motor controller 9A for controlling the rotational speed of the AC servo motor 11 on the basis of a signal from the controlling unit 10. The signal from the controlling unit 10 is sent to the motor controller 9A, which in turn controls the rotational speed of the AC servo motor 11. In this manner, the AC servo motor 11 is rotated and driven. With this, the rotational speed of the intermediate drag roller 2 is changed. Note that the rotational speed changing unit 9 also serves as a drive unit, because it drives the intermediate drag roller 2 to change the rotational speed of the intermediate drag roller 2.

Although the rotational speed changing unit 9 in this embodiment is equipped with the AC servo motor 11, the rotational speed changing unit 9 is not to be limited to this, but may be various units or means. For instance, the AC servo motor 11, a continuously variable transmission 11B, and a continuously variable transmission controller 9B may be provided as the rotational speed changing unit 9. In this case, the main shaft of the AC servo motor 11 is connected to the shaft end portion of the intermediate drag roller 2 through the continuously variable transmission 11B. Based on a signal from the controlling unit 10, the continuously variable transmission controller 9B controls the gear ratio of the continuously variable transmission 11B to suitably control the rotational speed of the AC servo motor 11. The controlled rotational speed is transmitted to the intermediate roller 2. With this, the rotational speed of the intermediate roller 2 is changed.

Also, although the rotational speed changing unit 9 in this embodiment is equipped with the motor controller 9A or the continuously variable transmission controller, they may be included in the controlling unit 10 to be described later.

The controlling unit 10 is constructed so that it feeds back the measured value regarding the exterior circumferential surface temperature of the intermediate drag roller 2 measured by the thermometer 8, thereby setting the rotational speed of the intermediate drag roller 2 so that the circumferential speed of the intermediate drag roller 2 reaches a circumferential speed corresponding to the exterior circumferential surface temperature of the intermediate drag roller 2. A signal for setting the rotational speed of the intermediate drag roller 2 is output from the controlling unit 10 to the aforementioned rotational speed changing unit 9.

For this reason, the controlling unit 10 is constructed so as to have a function (rotational speed setting means) of setting the rotational speed of the intermediate drag roller 2 so that the circumferential speed of the intermediate drag roller 2 reaches a target circumferential speed, based on the exterior circumferential surface temperature of the intermediate drag roller 2.

In this embodiment, the controlling unit 10 sets the rotational speed N of the intermediate drag roller 2 in accordance with the exterior circumferential surface temperature of the intermediate drag roller 2 by a temperature-speed conversion table 10A, thereby setting the rotational speed of the intermediate drag roller 2.

Note that the controlling unit 10 may be constructed so that it sets the diameter of the intermediate drag roller 2 in accordance with the exterior circumferential surface temperature of the intermediate drag roller 2 by a temperature-diameter conversion table 10B and then sets the rotational speed of the intermediate drag roller 2 in accordance with the diameter of the intermediate drag roller 2 by a diameter-speed conversion table 10C. With this, the rotational speed N of the intermediate drag roller 2 is calculated.

Here, there is a relation that the circumferential speed of the intermediate drag roller 2 will vary, if the exterior circumferential surface temperature or diameter of the intermediate drag roller 2 varies. Therefore, the exterior circumferential surface temperature or diameter of the intermediate drag roller 2 is referred to as a parameter that has influence on the circumferential speed of the intermediate drag roller 2.

In addition, the controlling unit 10 may be constructed so as to have a function (calculation means) of calculating a variation in the diameter of the intermediate drag roller 2 from a variation in the exterior circumferential surface temperature of the intermediate drag roller 2. With this, the rotational speed of the intermediate drag roller 2 is set in accordance with the calculated variation in the diameter so that the circumferential speed of the intermediate drag roller 2 reaches a target circumferential speed.

Next, for the drag roller control method (control algorithm) that is carried out by the drag roller control apparatus according to this embodiment, a description will be made in reference to FIG. 3.

In the drag roller control method of this embodiment, if the operation of the web type electronic printing machine is started (step S10), the exterior circumferential surface temperature of the intermediate drag roller 2 is measured by the thermometer 8 (step S20). Note that step S20 is referred to as a temperature checking step.

The exterior circumferential surface temperature (temperature value) measured by the thermometer 8 is sent to the controlling unit 10. The controlling unit 10 sets the rotational speed N of the intermediate drag roller 2 in accordance with the exterior circumferential surface temperature measured with the thermometer 8 by the temperature-speed conversion table 10A, in which prospective rotational speeds corresponding to various exterior circumferential surface temperatures of the drag roller are previously set, for converting exterior circumferential surface temperature to rotational speed N. With this, the rotational speed N of the intermediate drag roller 2 is set (step S30). Note that step S30 is referred to as a temperature/speed setting step.

Figure 4:
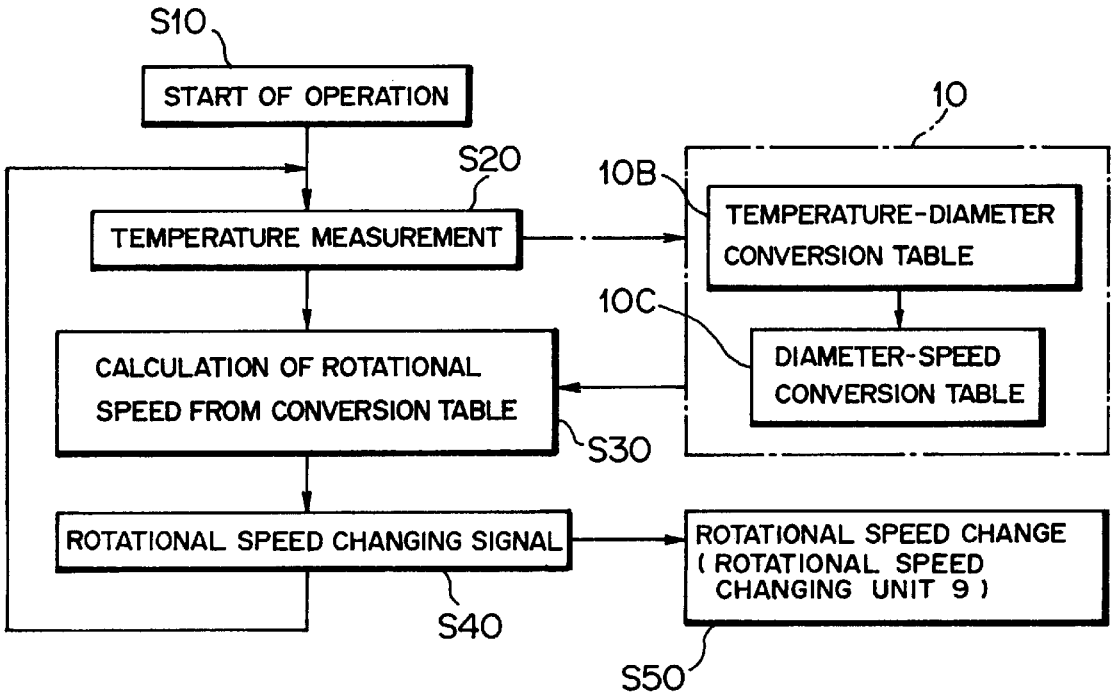
FIG. 4 is a diagram similar to FIG. 3 showing a modification of the conversion table.

In this embodiment, while the rotational speed N of the intermediate drag roller 2 is calculated by the temperature-speed conversion table 10A, the present invention is not limited to this. As shown in FIG. 4, the controlling unit 10 may be equipped with a temperature-diameter conversion table 10B, in which prospective drag roller diameters corresponding to various exterior circumferential surface temperatures of the drag roller are previously registered, for converting exterior circumferential surface temperature to the diameter of the intermediate drag roller 2 and a diameter-speed conversion table 10C, in which prospective rotational speeds corresponding to said drag roller diameters registered in said temperature-diameter table are previously set, for converting the diameter of the intermediate drag roller 2 to the rotational speed N. With the temperature-diameter conversion table 10B, the diameter of the intermediate drag roller 2 is first set in accordance with the exterior circumferential surface temperature measured by the thermometer 8 (temperature/diameter setting step). Then, with the diameter-speed conversion table 10C, the rotational speed N of the intermediate drag roller 2 is set in accordance with the diameter of the intermediate drag roller 2 set by the temperature-diameter conversion table 10B (diameter/speed setting step). With this, the rotational speed N of the intermediate drag roller 2 is set.

Subsequently, the set rotational speed N is issued to the rotational speed changing unit 9 of the intermediate drag roller 2 as a rotational speed changing signal (step S40). Note that step S40 is referred to as a control signal issuing step. Then, the rotational speed changing signal is input to the motor controller 9A of the rotational speed changing unit 9. The motor controller 9A operates an AC servo motor 11, thereby changing the rotational speed of the intermediate drag roller 2. Based on the exterior circumferential surface temperature measured by the thermometer 8, the circumferential speed of the intermediate drag roller 2 is controlled (step S50). Note that step S50 is referred to as a rotational speed changing step.

In the above-mentioned rotational speed setting step, while the rotational speed N of the intermediate drag roller 2 is calculated with the conversion tables 10A, 10B, and 10C by rotational speed setting means (controlling unit 10), the present invention is not limited to this.

Figure 3:
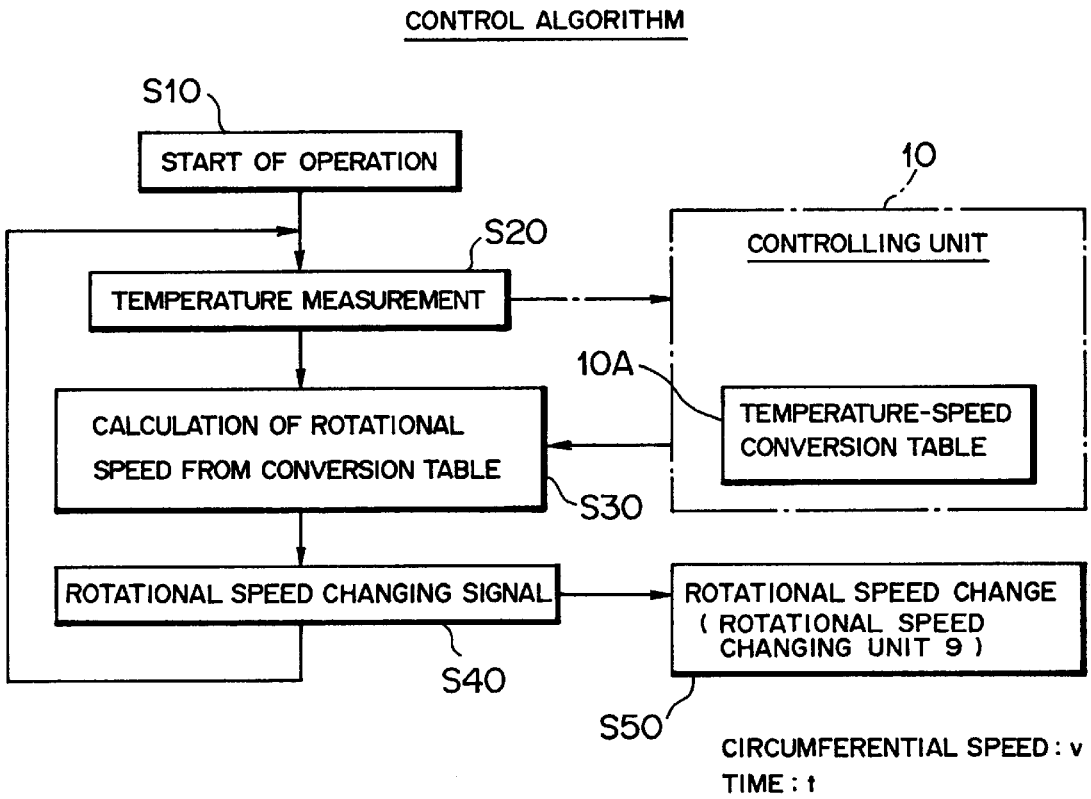
FIG. 3 is a block diagram showing a control algorithm for explaining a drag roller control method according to an embodiment of the present invention.

For example, as shown in FIG. 3, assuming that the diameter of the intermediate drag roller 2 in the initial state, i.e., state at the time of start of operation at normal exterior circumferential surface temperature (reference temperature) is $D_0$ and the rotational speed in this case (basic rotational speed) is $N_0$ and also assuming that the diameter of the intermediate drag roller 2 after expansion (at the time of elevated temperature) is D ($D_0$<D) and the rotational speed corresponding to this diameter D (after-expansion rotational speed) is N ($N_0$>N), there is a need to control the rotational speed of the intermediate drag roller 2 in view of the following equation (6) and the state of the web 6 fed by the web feeding unit 4 in order to make the circumferential speed (target circumferential speed) v of the intermediate drag roller 2 constant.

$$v=\pi\cdot D_0\cdot N_0=\pi\cdot D\cdot N \tag{6}$$

That is, the intermediate drag roller 2 rise in temperature and expands, so that the diameter becomes the diameter D after expansion which is greater than the diameter $D_0$ at the time of start of operation. For this reason, there is a need to set the rotational speed of the intermediate drag roller 2 to the after-expansion rotational speed N slower than the basic rotational speed $N_0$, as a basis.

In other words, in the above-mentioned rotational speed setting step (step S30), the controlling unit 10 may be constructed so as to perform the calculation step of calculating the diameter D after expansion of the intermediate drag roller 2 on the basis of the exterior circumferential surface temperature measured by the thermometer 8 and also perform the set step of setting the rotational speed of the intermediate drag roller 2 to the rotational speed N slower than a previously set rotational speed $N_0$ in the initial state so that the circumferential speed of the intermediate drag roller 2 reaches a predetermined target circumferential speed, based on the relation between the previously set diameter $D_0$ and rotational speed $N_0$ of the intermediate drag roller 2 in the initial state, i.e., state at the time of start of operation at normal exterior circumferential surface temperature (reference temperature) and the diameter D after expansion calculated in the aforementioned manner.

With this, the web transfer quantity at the time of start of operation and the web transfer quantity after expansion can be made equal to each other, as indicated by the following equation (7):

$$vt=\pi\cdot D_0\cdot N_0\cdot t=\pi\cdot D\cdot N\cdot t \tag{7}$$

Note that the variation in the diameter ($D-D_0$) and the rate of change in the diameter ($D/D_0$) of the intermediate drag roller 2 can be calculated based on various conditions, such as a coefficient of volume expansion, which are determined by the material of the intermediate drag roller 2, a difference in temperature, roller dimensions and like. Therefore, as described above, in the case where the rotational speed of the intermediate drag roller 2 is set based on the diameter of the intermediate drag roller 2, the variation in the diameter ($D-D_0$) and the rate of change in the diameter ($D/D_0$) of the intermediate drag roller 2 are calculated.

Then, based on these, the rotational speed of the intermediate drag roller 2 can be set.

The drag roller control apparatus according to this embodiment can stably transfer the web 6 to the printing units 7*a*~7*d* regardless of a variation in diameter due to the exterior circumferential surface temperature change of the intermediate drag roller 2 and can remove the disadvantage that the printing position shifts due to a state variation such as the tension or elongation of the web 6, because it has the aforementioned construction and functions. With this, there is an advantage that printing quantity can be considerably enhanced.

In connection with this, the number of sheets of damaged paper resulting from defective printing is reduced, so that there is also an advantage that cost reduction can be achieved.

Next, a description will be made of modifications of the drag roller control apparatus and the drag roller control method according to this embodiment.

In the aforementioned embodiment, the exterior circumferential surface temperature of the intermediate drag roller 2 is measured by the thermometer 8. Then, based on the measured temperature, the diameter of the intermediate drag roller 2 is calculated. In accordance with this diameter, the rotational speed of the intermediate drag roller 2 is set so that the circumferential speed of the intermediate drag roller 2 reaches a target circumferential speed. On the other hand, in this modification, the diameter of the intermediate drag roller 2 is directly measured by a laser beam, a high frequency, or the other measuring means (diameter monitoring unit). In accordance with this diameter, the rotational speed of the intermediate drag roller 2 is set so that the circumferential speed of the intermediate drag roller 2 reaches a target circumferential speed. Note that the remaining construction is the same as the above-mentioned embodiment.

In this case, the controlling unit 10 is constructed so that it sets the rotational speed of the intermediate drag roller 2 so that the circumferential speed of the intermediate drag roller 2 reaches a target circumferential speed, based on the diameter of the intermediate drag roller 2 measured by the diameter measuring means.

The controlling unit 10 here sets the rotational speed of the intermediate drag roller 2 in accordance with the diameter of the intermediate drag roller 2 measured with the diameter measuring means by the diameter-speed conversion table 10C, thereby setting the rotational speed of the intermediate drag roller 2.

Here, there is a relation that the circumferential speed of the intermediate drag roller 2 will vary, if the diameter of the intermediate drag roller 2 varies. Therefore, the diameter of the intermediate drag roller 2 is referred to as a parameter that has influence on the circumferential speed of the intermediate drag roller 2.

Note that, as with the aforementioned embodiment, the rotational speed of the intermediate drag roller 2 may be set in accordance with the variation or rate of change in the diameter of the intermediate drag roller 2 calculated based on the diameter of the intermediate drag roller 2 directly measured.

The drag control method, which is carried out by the drag roller control apparatus according to the modification constructed as described above, is as follows:

In this drag roller control method, if the operation of the web type electronic printing machine is started, the diameter of the intermediate drag roller 2 is directly measured by the diameter measuring means (diameter measuring step).

The diameter measured by the diameter measuring means is sent to the controlling unit 10. The controlling unit 10 sets the rotational speed N of the intermediate drag roller 2 in accordance with the diameter detected with the diameter measuring means by the diameter-speed conversion table 10C for converting diameter to rotational speed N (diameter/speed setting step). With this, the rotational speed N of the intermediate drag roller 2 is set (rotational seep setting step).

Subsequently, the set rotational speed N is transmitted to the rotational speed changing unit 9 of the intermediate drag roller 2 as a rotational speed changing signal. Then, the AC servo motor 11 constituting the rotational speed changing unit 9 is operated, whereby the rotational speed of the intermediate drag roller 2 is changed. With this, the circumferential speed of the intermediate drag roller 2 is controlled based on the diameter measured by the diameter measuring means (rotational speed changing step).

With this, as with the aforementioned embodiment, the web 6 can be stably transferred regardless of a variation in the diameter of the intermediate drag roller 2. With this, the modification of the aforementioned embodiment can remove the disadvantage that the printing position shifts due to the tension or elongation variation of the web 6. With this, there is an advantage that printing quantity can be considerably enhanced. In connection with this, the number of sheets of damaged paper resulting from defective printing is reduced, so that there is also an advantage that cost reduction can be achieved.

In addition, in this embodiment, while the drag roller control apparatus is provided for controlling the intermediate drag roller 2, the drag roller control apparatuses of the same construction may be provided for controlling the paper feeding roller 1 and the paper discharging roller 3. In this case, the traveling state (transferring state) of the web 6 can be controlled more stably.

In the above case, the thermometer 8 as the temperature measuring means needs to be provided at a position adjacent to the intermediate drag roller 2. Also, the thermometers 8 need to be provided at positions adjacent to the paper feeding roller 1 and the paper discharging roller 3. Furthermore, for the paper feeding roller 1 and the paper discharging roller 3, the same control as the drag roller control apparatus regarding the intermediate drag roller 2 needs to be performed. With this, the traveling state (feeding state) of the web 6 with respect to the printing units 7*a*~7*d* can be controlled more ideally.

Moreover, the thermometer 8 as the temperature measuring means may be provided only at a position adjacent to the intermediate drag roller 2. Based on the measured information, a variation in the diameter of the intermediate drag roller 2 is calculated and variations in the diameters of the paper feeding roller 1 and the paper discharging roller 3 are also calculated. For the paper feeding roller 1 and the paper discharging roller 3, the same control as the drag roller control apparatus regarding the intermediate drag roller 2 is performed. With this, although the structure is simpler, the traveling state (feeding state) of the web 6 with respect to the printing units 7*a*~7*d* can be made better.

While the present invention has been described with reference to the preferred embodiment thereof, the invention is not to be limited to the details given herein, but may be modified within the scope of the appended claims.

What is claimed is:

1. A drag roller control apparatus for controlling a drag roller, disposed downstream of a heat roller, to adjust the rate of transfer of a printing web, in a printing system, said apparatus comprising:

a temperature monitoring unit for indirectly measuring a temperature of the drag roller in terms of a temperature of the web pulled by the drag roller;

a controlling unit, operatively connected with said temperature monitoring unit, for issuing a control signal for controlling a rotational speed of the drag roller so as to adjust a circumferential speed of the drag roller, said circumferential speed corresponding to said temperature checked by said temperature monitoring unit, to a preset speed corresponding to a reference temperature of the drag roller; and a rotational speed changing unit, operatively connected with said controlling unit, for changing said rotational speed of the drag roller in accordance with said control signal issued from said controlling unit.

2. A drag roller control apparatus according to claim 1, wherein said controlling unit is associated with a temperature-speed table in which prospective rotational speeds corresponding to various temperatures of the drag roller are previously set.

3. A drag roller control apparatus according to claim 1, wherein said controlling unit is associated with:

a temperature-diameter table in which prospective drag roller diameters corresponding to various temperatures of the drag roller are previously registered; and a diameter-speed table in which prospective rotational speeds corresponding to said drag roller diameters registered in said temperature-diameter table are previously set.

4. A drag roller control apparatus according to claim 1, wherein said temperature monitoring unit includes a non-contact type thermometer.

5. A drag roller control apparatus according to claim 1, wherein said rotational speed changing unit includes:

a motor adapted to be operatively connected to the drag roller; and a motor controller, operatively connected to said motor, for controlling a rotational speed of said motor in accordance with said control signal issued from said controlling unit.

6. A drag roller control apparatus according to claim 1, wherein said rotational speed changing unit includes:

a motor adapted to be operatively connected to the drag roller via a continuously variable transmission; and a continuously variable transmission controller for issuing a transmission control signal for controlling a gear ratio of said continuously variable transmission in accordance with said control signal issued from said controlling unit.

7. A drag roller control method of controlling a drag roller, disposed downstream of a heat roller, to adjust the rate of transfer of a printing web, in a printing system, said method comprising the steps of:

indirectly measuring a temperature of the drag roller in terms of a temperature of the printing web, which is pulled by the drag roller, by a temperature monitoring unit;

issuing a control signal for controlling a rotational speed of the drag roller so as to adjust a circumferential speed of the drag roller, said circumferential speed corresponding to said temperature indirectly measured in said temperature measuring step, to a preset speed corresponding to a reference temperature of the drag roller by a controlling unit operatively connected with said temperature monitoring unit; and changing said rotational speed of the drag roller in accordance with said control signal issued in said control signal issuing step by a rotational speed changing unit operatively connected with said controlling unit.

8. A drag roller control method according to claim 7, wherein said control signal issuing step includes previously setting prospective rotational speeds corresponding to various temperatures of the drag roller into a temperature-speed table.

9. A drag roller control method according to claim 7, wherein said control signal issuing step includes:

previously registering drag roller diameters corresponding to various temperatures into a temperature-diameter table; and previously setting rotational speeds of the drag roller corresponding to said drag roller diameters, which is registered in the temperature-diameter table in said drag roller diameters registering step, into a diameter-speed table.

10. A drag roller control method according to claim 7, wherein said rotational speed changing unit to be used in said rotational speed changing step includes:

a motor adapted to be operatively connected to the drag roller; and a motor controller, operatively connected to said motor, for controlling a rotational speed of said motor in accordance with the control signal, which is issued from said controlling unit, to change the rotational speed of the drag roller in terms of a rotational speed change of said motor.

11. A drag roller control method according to claim 7, wherein said rotational speed changing unit to be used in said rotational speed changing step includes:

a motor adapted to be operatively connected to the drag roller via a continuously variable transmission; and a continuously variable transmission controller for issuing a transmission control signal for controlling a gear ratio of said continuously variable transmission in accordance with the control signal, which is issued from said controlling unit, to change the rotational speed of the drag roller in terms of a gear ratio change of said continuously variable transmission.

* * * * *